US006590477B1

(12) United States Patent
Elco

(10) Patent No.: US 6,590,477 B1
(45) Date of Patent: Jul. 8, 2003

(54) WAVEGUIDES AND BACKPLANE SYSTEMS WITH AT LEAST ONE MODE SUPPRESSION GAP

(75) Inventor: Richard A. Elco, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/429,812

(22) Filed: Oct. 29, 1999

(51) Int. Cl.[7] ..... H01P 3/12
(52) U.S. Cl. ..... 333/239; 333/248; 333/251
(58) Field of Search ..... 333/239, 248, 333/251

(56) References Cited

U.S. PATENT DOCUMENTS

| | | | | |
|---|---|---|---|---|
| 3,315,187 | A | 4/1967 | Tsuneo Nakahara et al. | 333/239 |
| 3,686,590 | A | 8/1972 | Dischert | 333/24.1 |
| 3,784,938 | A | 1/1974 | Cuthbert et al. | 333/239 |
| 4,001,733 | A | 1/1977 | Birch et al. | 333/24.1 |
| 4,156,907 | A | 5/1979 | Rawlings et al. | |
| 4,200,930 | A | 4/1980 | Rawlings et al. | |
| 4,292,669 | A | 9/1981 | Wollum et al. | |
| 4,587,651 | A | 5/1986 | Nelson et al. | |
| 4,673,897 | A | 6/1987 | Chua et al. | 333/26 |
| 4,777,657 | A | 10/1988 | Gillaspie | 455/186 |
| 4,818,963 | A | 4/1989 | Green | 333/24.1 |
| 4,862,186 | A | 8/1989 | Strider | 343/776 |
| 4,970,522 | A | 11/1990 | Niman | 342/374 |
| 5,004,993 | A | 4/1991 | Reindel | 333/208 |
| 5,359,714 | A | 10/1994 | Avaneas | 395/275 |
| 5,363,464 | A | 11/1994 | Way et al. | 385/125 |
| 5,416,492 | A | 5/1995 | Takahashi et al. | 343/771 |
| 5,473,296 | A | 12/1995 | Ishikawa et al. | 333/239 |
| 5,637,521 | A | 6/1997 | Rhodes et al. | 438/619 |
| 5,818,385 | A | 10/1998 | Bartholomew | 342/372 |

(List continued on next page.)

FOREIGN PATENT DOCUMENTS

| | | | | |
|---|---|---|---|---|
| DE | 750 554 C | | 1/1945 | |
| DE | 893819 | * | 10/1953 | 333/239 |
| DE | 1275649 | * | 8/1968 | 333/239 |
| EP | 0 604 333 A1 | | 6/1994 | |

OTHER PUBLICATIONS

"Development of a Laminated Waveguide"; *IEEE Transactions on Microwave Theory and Techniques*; vol. 46, No. 12, pp. 2438–2443, Dec., 1988.

United States Statutory Invention Registration, Riley, et al, Registration No. H321, Published Aug. 4, 1987.

(List continued on next page.)

*Primary Examiner*—Benny Lee
(74) *Attorney, Agent, or Firm*—Woodcock Washburn LLP

(57) ABSTRACT

Waveguides and backplanes systems are disclosed. A waveguide according to the present invention includes a first conductive channel, and a second conductive channel disposed generally parallel to the first channel. A gap is defined between the first and second channels that allows propagation along a waveguide axis of electromagnetic waves in a TE n,0 mode, wherein n is an odd number, but suppresses electromagnetic waves in a TE m,0 mode, wherein m is an even number. An NRD waveguide is disclosed that includes an upper conductive plate and a lower conductive plate, with a dielectric channel disposed between the conductive plates. A second channel is disposed adjacent to the dielectric channel between the conductive plates. The upper conductive plate has a gap above the dielectric channel that allows propagation along a waveguide axis of electromagnetic waves in an odd longitudinal magnetic mode, but suppresses electromagnetic waves in an even longitudinal magnetic mode. A backplane system according to the invention includes a substrate with a waveguide connected thereto. The backplane system includes at least one transmitter connected to the waveguide for sending an electrical signal along the waveguide, and at least one receiver connected to the waveguide for accepting the electrical signal.

12 Claims, 18 Drawing Sheets

U.S. PATENT DOCUMENTS

| | | | | |
|---|---|---|---|---|
| 5,825,268 | A | 10/1998 | Ishikawa et al. | 333/254 |
| 5,861,782 | A | 1/1999 | Saitoh | 333/239 |
| 6,496,611 | B1 | 12/2002 | Ohtsuka | 385/11 |

OTHER PUBLICATIONS

Butterwick, H.J., "Mode filters for oversized rectangular waveguides," *IEEE Transactions on Microwave Theory and Techniques*, May 1968, MTT–16(5), 274–281.

Huang, J. et al., "Computer–aided design and optimization of NRD–guide mode suppressors," *IEEE Transactions on Microwave Theory and Techniques*, Jun. 1996, 44(6), 905–910.

Malherbe, J.A.G., "Leaky–wave antenna in nonradiative dielectric waveguide," *IEEE Transactions on Antennas and Propagation*, Sep. 1988, 36(9), 1231–1235.

Stevens, D., et al., "Microwave characterization and modeling of multilayered cofired ceramic waveguides," *Intern. J. Microcircuits and Electronic Packaging, International Microelectronics & Packaging Society*, First Quarter 1999, 22(1), 43–48.

Ubalov, V.V., "Slot filter for H2M,O waves in a multiwave rectangular waveguide,"*Radio engineering and Electronic Physics*, Feb. 1975, 20(2), 129–131.

EPO Communication and Partial European Search Report dated Jul. 29, 2002 (EP 00 12 3315).

Markstein, H. W., "Ensuring Signal Integrity in Connectors, Cables and Backplanes", *Electronics Packaging and Production*, 1996, 36(11), 61–69.

Markstein, H. W., "Impedances Dictate Backplane Design", *Electronic Packaging and Production*, 1993, 33(12), 38–40.

* cited by examiner

WAVEGUIDES AND BACKPLANE SYSTEMS WITH AT LEAST ONE MODE SUPPRESSION GAP

FIELD OF THE INVENTION

This invention relates to waveguides and backplane systems. More particularly, the invention relates to broadband microwave modem waveguide backplane systems.

BACKGROUND OF THE INVENTION

The need for increased system bandwidth for broadband data transmission rates in telecommunications and data communications backplane systems has led to several general technical solutions. A first solution has been to increase the density of moderate speed parallel bus structures. Another solution has focused on relatively less dense, high data rate differential pair channels. These solutions have yielded still another solution—the all cable backplanes that are currently used in some data communications applications. Each of these solutions, however, suffers from bandwidth limitations imposed by conductor and printed circuit board (PCB) or cable dielectric losses.

The Shannon-Hartley Theorem provides that, for any given broadband data transmission system protocol, there is usually a linear relationship between the desired system data rate (in Gigabits/sec) and the required system 3 dB bandwidth (in Gigahertz). For example, using fiber channel protocol, the available data rate is approximately four times the 3 dB system bandwidth. It should be understood that bandwidth considerations related to attenuation are usually referenced to the so-called "3 dB bandwidth."

Traditional broadband data transmission with bandwidth requirements on the order of Gigahertz generally use a data modulated microwave carrier in a "pipe" waveguide as the physical data channel because such waveguides have lower attenuation than comparable cables or PCB's. This type of data channel can be thought of as a "broadband microwave modem" data transmission system in comparison to the broadband digital data transmission commonly used on PCB backplane systems. The present invention extends conventional, air-filled, rectangular waveguides to a backplane system. These waveguides are described in detail below.

Another type of microwave waveguide structure that can be used as a backplane data channel is the non-radiative dielectric (NRD) waveguide operating in the transverse electric 1,0 (TE 1,0) mode. The TE 1,0 NRD waveguide structure can be incorporated into a PCB type backplane bus system. This embodiment is also described in detail in below. Such broadband microwave modem waveguide backplane systems have superior bandwidth and bandwidth-density characteristics relative to the lowest loss conventional PCB or cable backplane systems.

An additional advantage of the microwave modem data transmission system is that the data rate per modulated symbol rate can be multiplied many fold by data compression techniques and enhanced modulation techniques such as K-bit quadrature amplitude modulation (QAM), where K=16, 32, 64, etc. It should be understood that, with modems (such as telephone modems, for example), the data rate can be increased almost a hundred-fold over the physical bandwidth limits of so-called "twisted pair" telephone lines.

Waveguides have the best transmission characteristics among many transmission lines, because they have no electromagnetic radiation and relatively low attenuation. Waveguides, however, are impractical for circuit boards and packages for two major reasons. First, the size is typically too large for a transmission line to be embedded in circuit boards. Second, waveguides must be surrounded by metal walls. Vertical metal walls cannot be manufactured easily by lamination techniques, a standard fabrication technique for circuit boards or packages. Thus, there is a need in the art for a broadband microwave modem waveguide backplane systems for laminated printed circuit boards.

SUMMARY OF THE INVENTION

A waveguide according to the present invention comprises a first conductive channel disposed along a waveguide axis, and a second conductive channel disposed generally parallel to the first channel. A gap is defined between the first and second channels along the waveguide axis. The gap has a gap width that allows propagation along the waveguide axis of electromagnetic waves in a TE n,0 mode, wherein n is an odd number, but suppresses electromagnetic waves in a TE m,0 mode, wherein m is an even number.

Each channel can have an upper broadwall, a lower broadwall opposite and generally parallel to the upper broadwall, and a sidewall generally perpendicular to and connected to the broadwalls. The upper broadwall of the first channel and the upper broadwall of the second channel are generally coplanar, and the gap is defined between the upper broadwall of the first channel and the upper broadwall of the second channel. Similarly, the lower broadwall of the first channel and the lower broadwall of the second channel are generally coplanar, and a second gap is defined between the lower broadwall of the first channel and the lower broadwall of the second channel. Thus, the first channel can have a generally C-shaped, or generally I-shaped cross-section along the waveguide axis, and can be formed by bending a sheet electrically conductive material.

In another aspect of the invention, an NRD waveguide having a gap in its conductor for mode suppression, comprises an upper conductive plate and a lower conductive plate, with a dielectric channel disposed along a waveguide axis between the conductive plates. A second channel is disposed along the waveguide axis adjacent to the dielectric channel between the conductive plates. The upper conductive plate has a gap along the waveguide axis above the dielectric channel. The gap has a gap width that allows propagation along the waveguide axis of electromagnetic waves in an odd longitudinal magnetic mode, but suppresses electromagnetic waves in an even longitudinal magnetic mode.

A backplane system according to the invention comprises a substrate, such as a printed circuit board or multilayer board, with a waveguide connected thereto. The waveguide can be a non-radiative dielectric waveguide, or an air-filled rectangular waveguide. According to one aspect of the invention, the waveguide has a gap therein for preventing propagation of a lower order mode into a higher order mode.

The backplane system includes at least one transmitter connected to the waveguide for sending an electrical signal along the waveguide, and at least one receiver connected to the waveguide for accepting the electrical signal. The transmitter and the receiver can be transceivers, such as broadband microwave modems.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed.

DETAILED DESCRIPTION OF PREFERRED EMBODIMENTS

Example of a Conventional System: Broadside Coupled Differential Pair PCB Backplane The attenuation (A) of a broadside coupled PCB conductor pair data channel has two components: a square root of frequency (f) term due to conductor losses, and a linear term in frequency arising from dielectric losses. Thus, $$A=(A_1*\mathrm{SQRT}(f)+A_2*f)*L*(8.686\ \mathrm{db/neper}) \quad (1)$$

where $$A1=(\pi*\mu_0*\rho)^{0.5}/(w/p)*p*Z_0 \quad (2)$$

and $$A_2=\pi*DF*(\mu_0*\in_0)^{0.5}. \quad (3)$$

The data channel pitch is p, w is the trace width, ρ is the resistivity of the PCB traces, and ∈ and DF are the permittivity and dissipation factor of the PCB dielectric, respectively. For scaling, w/p is held constant at −0.5 or less and $Z_0$ is held constant by making the layer spacing between traces, h, proportional to p where h/p=0.2. The solution of Equation (1) for A=3 dB yields the 3 dB bandwidth of the data channel for a specific backplane length, L.

Figure 1:
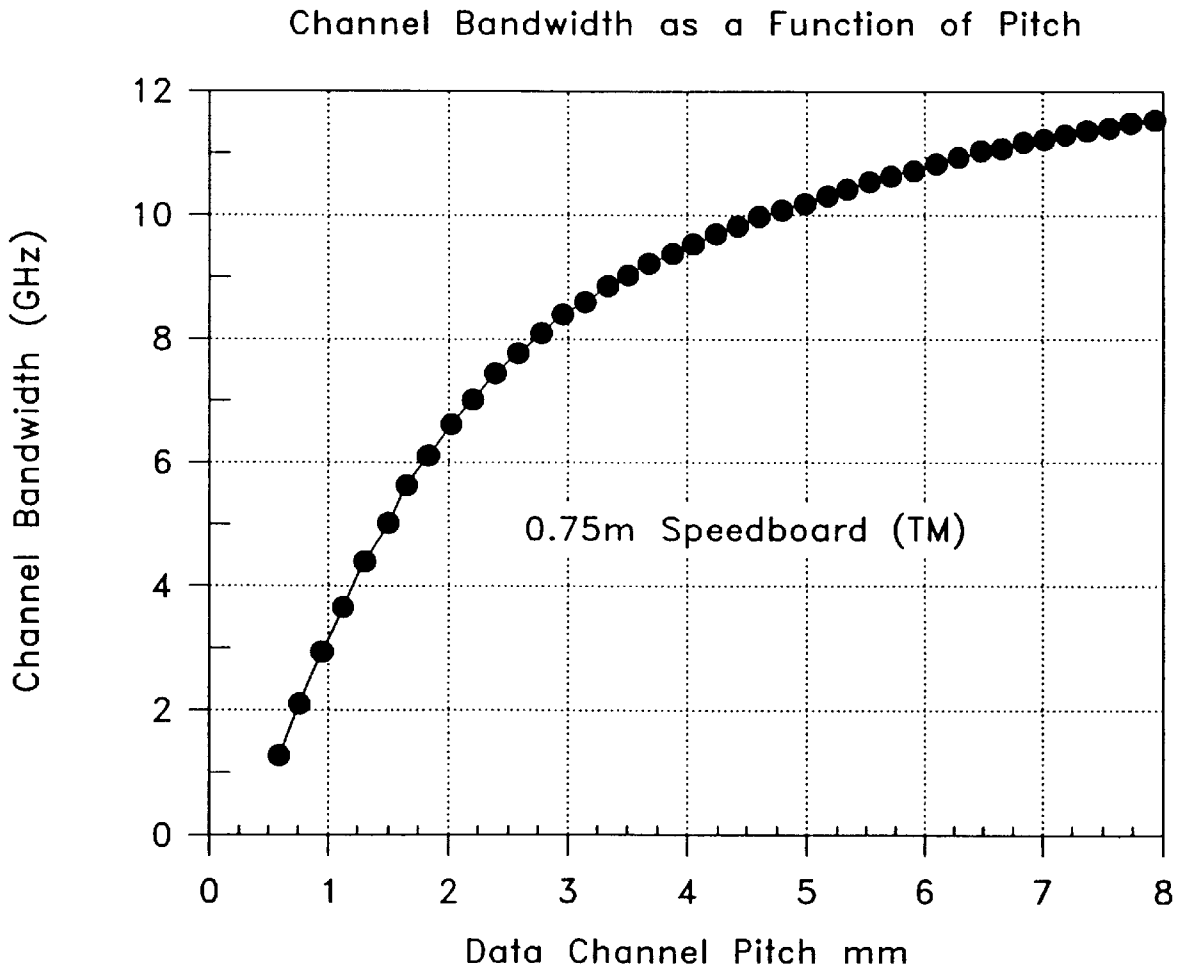
FIG. 1 shows a plot of channel bandwidth vs. data channel pitch for a 0.75 m prepreg backplane.
Figure 2:
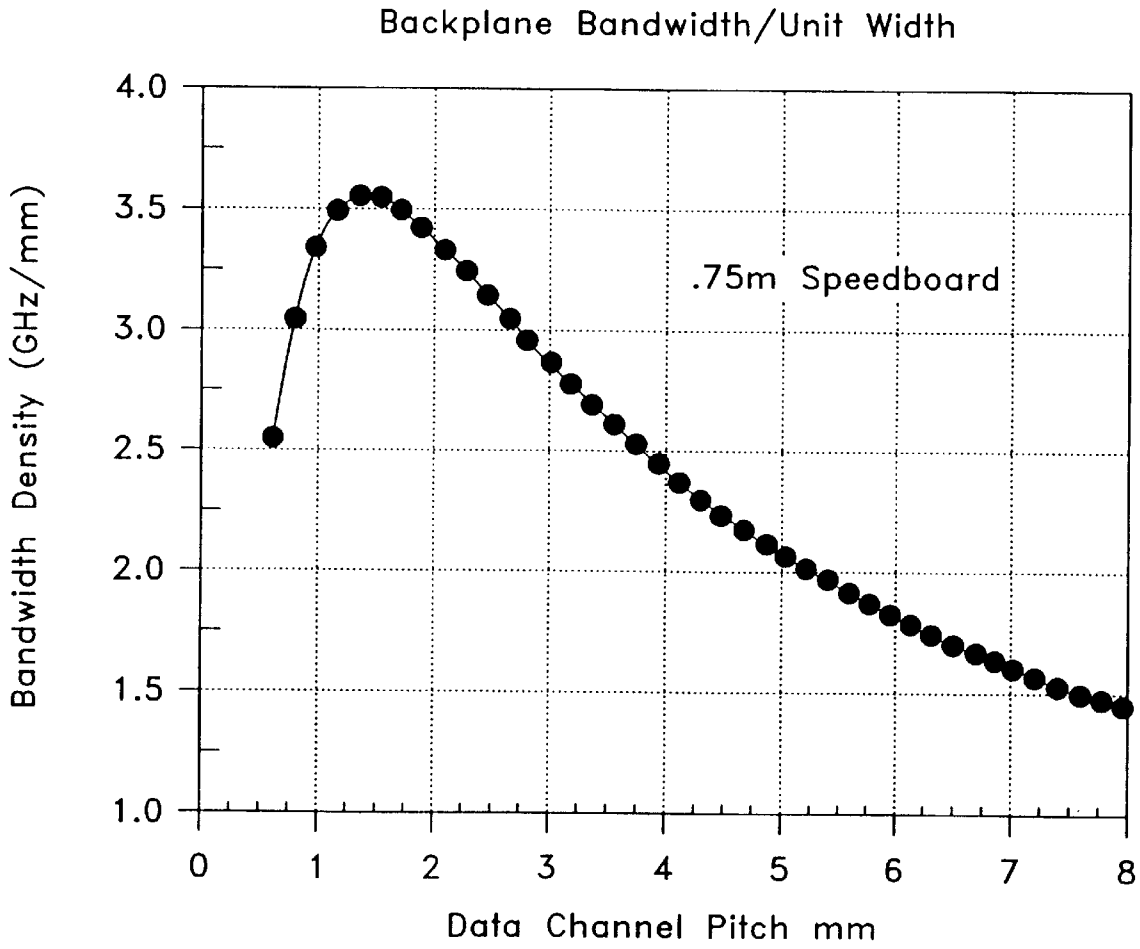
FIG. 2 shows a plot of bandwidth density vs. data channel pitch for a 0.75 m prepreg backplane.

"SPEEDBOARD," which is manufactured and distributed by Gore, is an example of a low loss, "TEFLON" laminate. FIG. 1 shows a plot of the bandwidth per channel for a 0.75 m "SPEEDBOARD" backplane as a function of data channel pitch. As the data channel pitch, p, decreases, the channel bandwidth also decreases due to increasing conductor losses relative to the dielectric losses. For a highly parallel (i.e., small data channel pitch) backplane, it is desirable that the density of the parallel channels increase faster than the corresponding drop in channel bandwidth. Consequently, the bandwidth density per channel layer, BW/p, is of primary concern. It is also desirable that the total system bandwidth increase as the density of the parallel channels increases. FIG. 2 shows a plot of bandwidth density vs. data channel pitch for a 0.75 m "SPEEDBOARD" backplane. It can be seen from FIG. 2, however, that the bandwidth-density reaches a maximum at a channel pitch of approximately 1.2 mm. Any change in channel pitch beyond this maximum results in a decrease in bandwidth density and, consequently, a decrease in system performance. The maximum in bandwidth density occurs when the conductor and dielectric losses are approximately equal.

Figure 3:
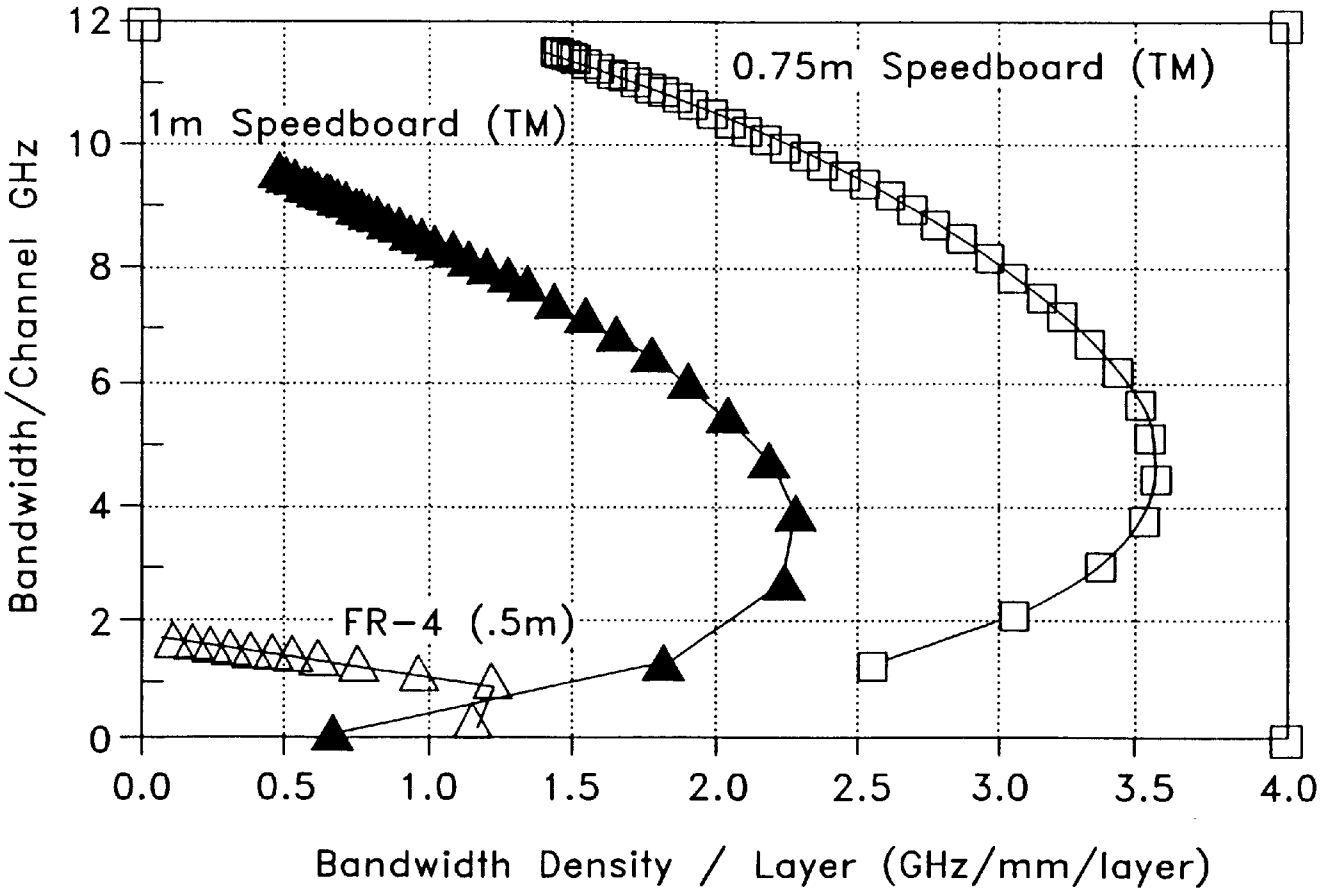
FIG. 3 shows a plot of bandwidth vs. bandwidth density/layer for a 0.5 m FR-4 backplane, and 1 m and 0.75 m prepreg backplanes.

The backplane connector performance can be characterized in terms of the bandwidth vs. bandwidth-density plane, or "phase plane" representation. Plots of bandwidth vs. bandwidth density/layer for a 0.5 m glass reinforced epoxy resin (e.g. "FR-4") backplane, and for 1.0 m and 0.75 m "SPEEDBOARD" backplanes are shown in FIG. 3, where channel pitch is the independent variable. It is evident that, for a given bandwidth density, there are two possible solutions for channel bandwidth, i.e., a dense low bandwidth "parallel" solution, and a high bandwidth "serial" solution. The limits on bandwidth-density for even high performance PCBs should be clear to those of skill in the art.

Backplane System

Figure 4:
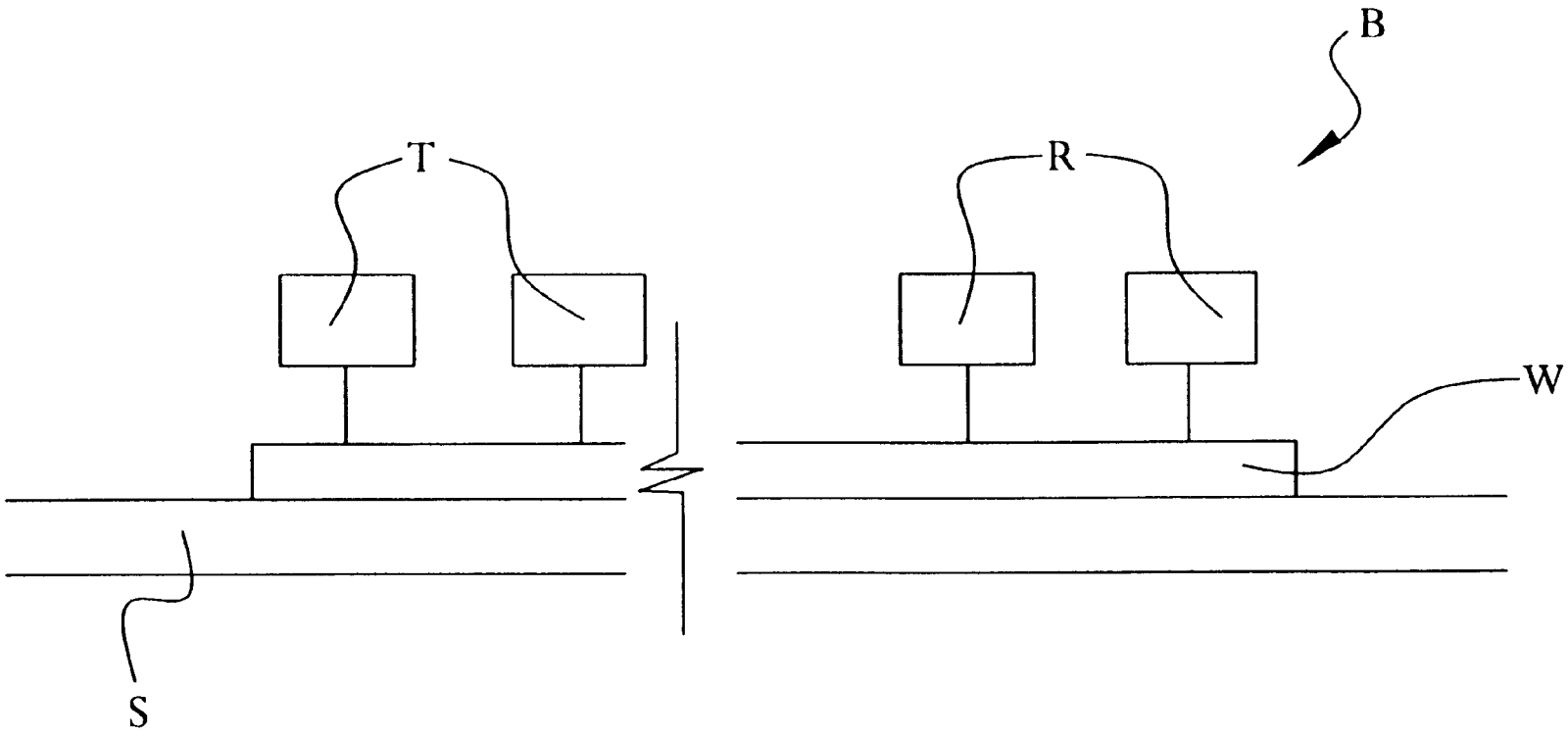
FIG. 4 shows a schematic of a backplane system in accordance with the present invention.

FIG. 4 shows a schematic of a backplane system B in accordance with the present invention. Backplane system B includes a substrate S, such as a multilayer board (MLB) or a printed circuit board (PCB). A waveguide W mounts to substrate S, either on an outer surface thereof, or as a layer in an inner portion of an MLB (not shown).

Waveguide W transports electrical signals between one or more transmitters T and one or more receivers R. Transmitters T and receivers R could be transceivers and, preferably, broad band microwave modems.

Preferably, backplane system B uses waveguides having certain characteristics. The preferred waveguides will now be described.

Air Filled Rectangular Waveguide Backplane System

Figure 5:
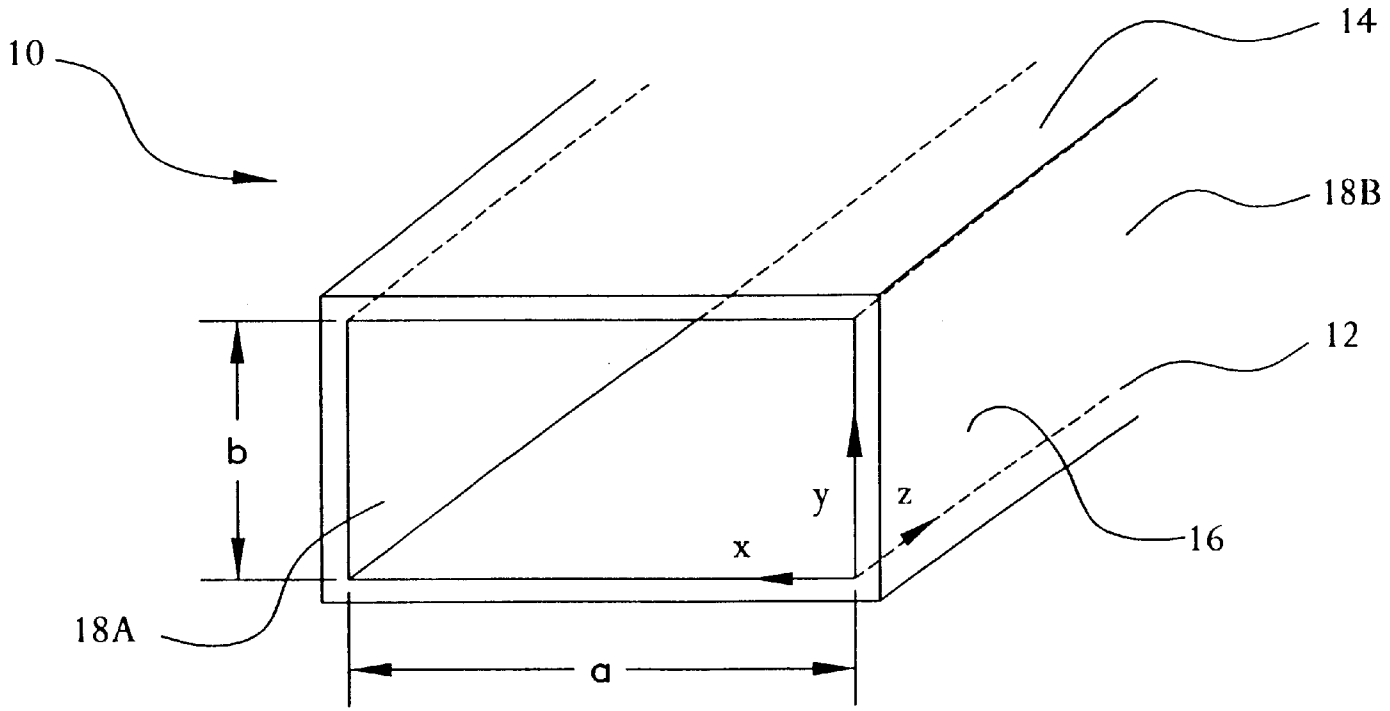
FIG. 5 depicts a closed, extruded, conducting pipe, rectangular waveguide.

FIG. 5 depicts a closed, extruded, conducting pipe, rectangular waveguide 10. Waveguide 10 is generally rectangular in cross-section and is disposed along a waveguide axis 12 (shown as the z-axis in FIG. 5). Waveguide 10 has an upper broadwall 14 disposed along waveguide axis 12, and a lower broadwall 16 opposite and generally parallel to upper broadwall 14. Waveguide 10 has a pair of sidewalls 18A, 18B, each of which is generally perpendicular to and connected to broadwalls 12 and 14. Waveguide 10 has a width a and a height b. Height b is typically less than width a. The fabrication of such a waveguide for backplane applications can be both difficult and expensive.

Figure 6:
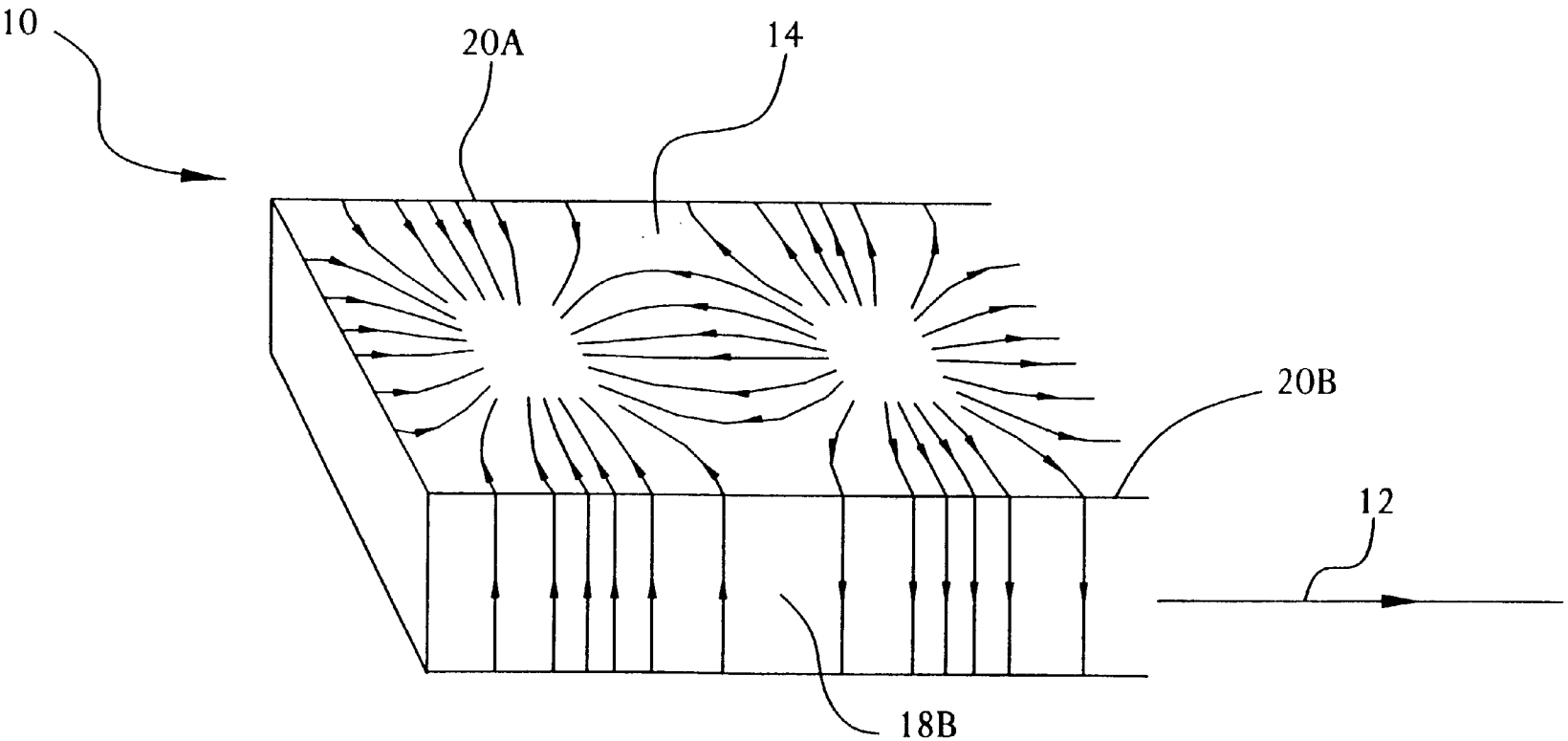
FIG. 6 depicts the current flows for the TE 1,0 mode in a closed, extruded, conducting pipe, rectangular waveguide.

FIG. 6 depicts the current flows for the TE 1,0 mode in walls 14 and 18B of waveguide 10. It can be seen from FIG. 6 that the maximum current is in the vicinity of the edges 20A, 20B of waveguide 10, and that the current in the middle of upper broadwall 14 is only longitudinal (i.e., along waveguide axis 12).

Figure 7A:
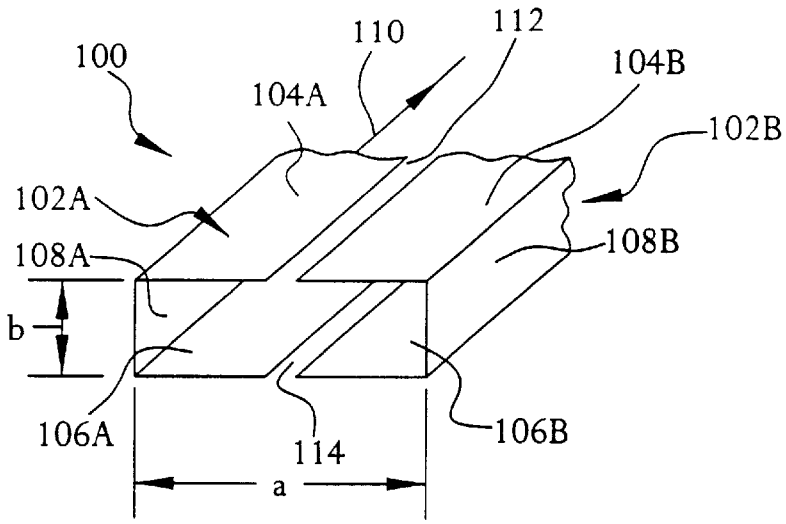
FIG. 7A depicts a split rectangular waveguide according to the present invention.

According to the present invention, a longitudinal gap is introduced in the broadwalls so that the current and field patterns for the TE 1,0 mode are unaffected thereby. As shown in FIG. 7A, a waveguide 100 of the present invention includes a pair of conductive channels 102A, 102B. First channel 102A is disposed along a waveguide axis 110. Second channel 102B is disposed generally parallel to first channel 102A to define a gap 112 between first channel 102A and second channel 102B.

Gap 112 allows propagation along waveguide axis 110 of electromagnetic waves in a TE n,0 mode, where n is an odd integer, but suppresses the propagation of electromagnetic waves in a TE n,0 mode, where n is an even integer. Waveguide 100 suppresses the TE n,0 modes for even values of n because gap 112 is at the position of maximum transverse current for those modes. Consequently, those modes cannot propagate in wave guide 100. Consequently, waves can continue to be propagated in the TE 1,0 mode, for example, until enough energy builds up to allow the propagation of waves in the TE 3,0 mode. Because the TE n,0 modes are suppressed for even values of n, waveguide 100 is a broadband waveguide.

Waveguide 100 has a width a and height b. To ensure suppression of the TE n,0 modes for even values of n, the height b of waveguide 100 is defined to be about 0.5 a or less. The data channel pitch p is approximately equal to a. The dimensions of waveguide 100 can be set for individual applications based on the frequency or frequencies of interest. Gap 112 can have any width, as long as an interruption of current occurs. Preferably, gap 112 extends along the entire length of waveguide 100.

As shown in FIG. 7A, each channel 102A, 102B has an upper broadwall 104A, 104B, a lower broadwall 106A, 106B opposite and generally parallel to its upper broadwall 104A, 104B, and a sidewall 108A, 108B generally perpendicular to and connected to broadwalls 104, 106. Upper broadwall 104A of first channel 102A and upper broadwall 104B of second channel 102B are generally coplanar. Gap 112 is defined between upper broadwall 104A of first channel 102A and upper broadwall 104B of the second channel 102B. Similarly, lower broadwall 106A of first channel 102A and lower broadwall 106B of second channel 102B are generally coplanar, with a second gap 114 defined therebetween. Sidewall 108A of first channel 102A is opposite and generally parallel to sidewall 108B of second channel 102B. Side walls 108A and 108B are disposed opposite one another to form boundaries of waveguide 100.

Figure 7B:
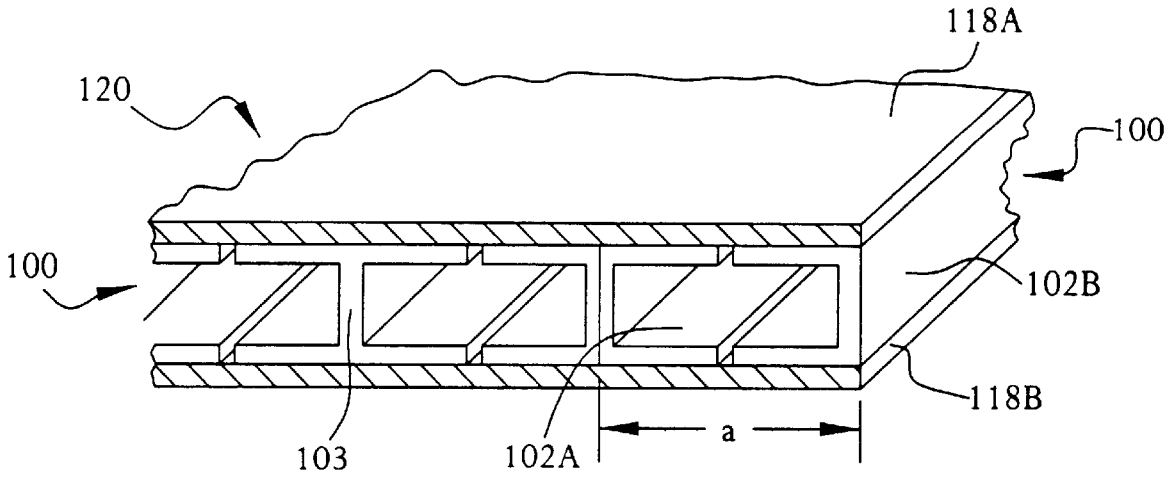
FIG. 7B depicts an air-filled waveguide backplane system according to the present invention.

An array of waveguides 100 can then be used to form a backplane system 120 as shown in FIG. 7B. As described above in connection with FIG. 7A, each waveguide 100 has a width, a. Backplane system 120 can be constructed using a plurality of generally "I" shaped conductive channels 103 or "C" shaped conductive channels 102A, 102B. Preferably, the conductive channels are made from a conductive material, such as copper, which can be fabricated by extrusion or by bending a sheet of conductive material. The conductive channels can then be laminated (by gluing, for example), between two substrates 118A, 118B, which, in a preferred embodiment, are printed circuit boards (PCBs). The PCBs could have, for example, conventional circuit traces (not shown) thereon.

Unlike the conventional systems described above, the attenuation in a waveguide 110 of present invention is less than 0.2 dB/meter and is not the limiting factor on bandwidth for backplane systems on the order of one meter long. Instead, the bandwidth limiting factor is mode conversion from a low order mode to the next higher mode caused by discontinuities or irregularities along the waveguide. (Implicit in the following analysis of waveguide systems is the assumption of single, upper-sideband modulation with or without carrier suppression.)

Figure 8:
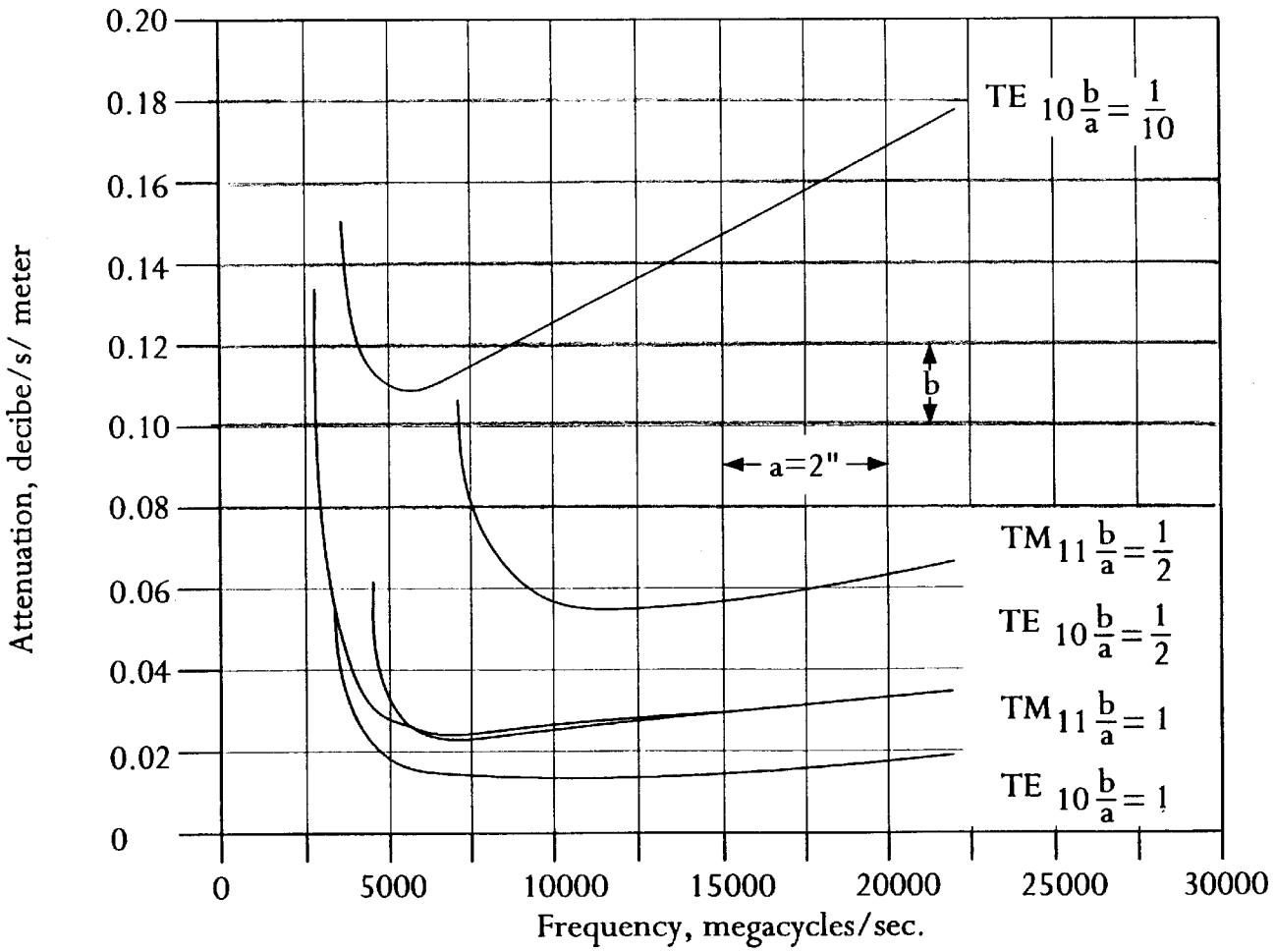
FIG. 8 shows a plot of attenuation vs. frequency in a rectangular waveguide.

FIG. 8 is a plot of attenuation vs. frequency in a rectangular waveguide 100 according to the present invention. It can be seen from FIG. 8 that the lowest operating frequency, $f_0$, that avoids severe attenuation near cutoff is approximately twice the TE 1,0 cutoff frequency, $f_c$, or $$fc<f_0\leqq 2*(c/2a)=c/a \quad (4).$$

The cutoff frequency for the TE 3,0 mode, which is the next higher mode because of gap 112, is three times the TE 1,0 cutoff frequency or $$f_m=3*(c/2a)=1.5*f_0 \quad (5).$$

The bandwidth, BW, based on the upper sideband limit, is then $(f_m-f_0)$, which, on substitution for c, the speed of light, is $$BW=150(\text{Ghz*mm})/p, \quad (6)$$

where p, the data channel pitch, has been substituted for a, the waveguide width. Again, b/p is defined to be less than 0.5 to suppress TE 0,n modes. The bandwidth density, BWD, is simply the bandwith divided by the pitch or $$BWD=BW/p=150/p*p(\text{Ghz/mm}) \quad (7).$$

Then the relationship between BW and BWD is $$BW=(150*BWD)^{0.5}(\text{Ghz}) \quad (8).$$

Figure 9:
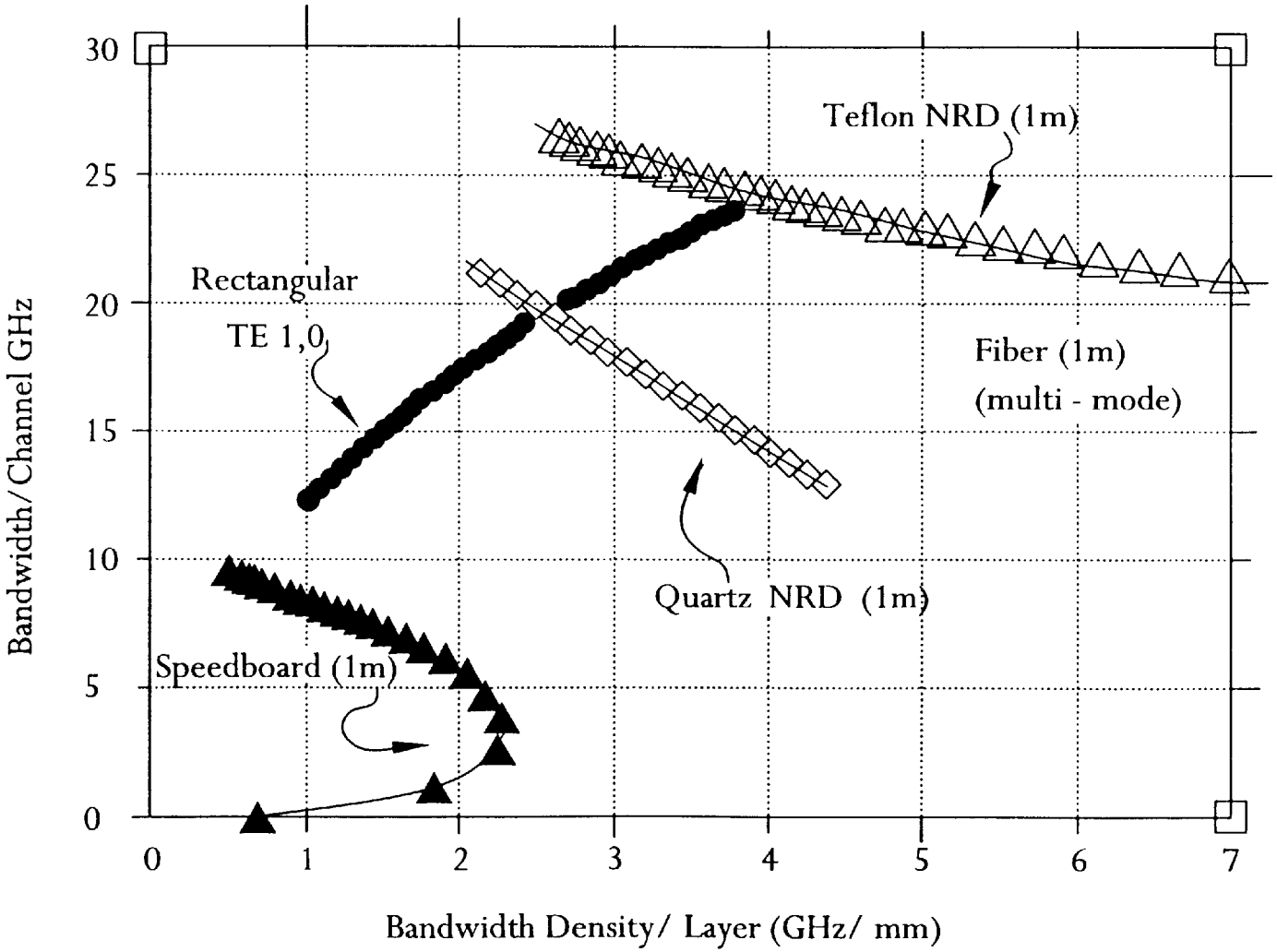
FIG. 9 shows plots of the bandwidth and bandwidth density characteristics of various waveguide backplane systems.

A plot of this relationship, corresponding to a frequency range of, for example, about 20 GHz to about 50 GHz, is shown relative to the bandwidth vs bandwidth density performance of a "SPEEDBOARD" backplane in FIG. 9. It can be seen from FIG. 9 that the bandwidth and bandwidth-density range obtainable with the rectangular TE 1,0 mode backplane system is approximately twice that of the "SPEEDBOARD" system.

Figure 10:
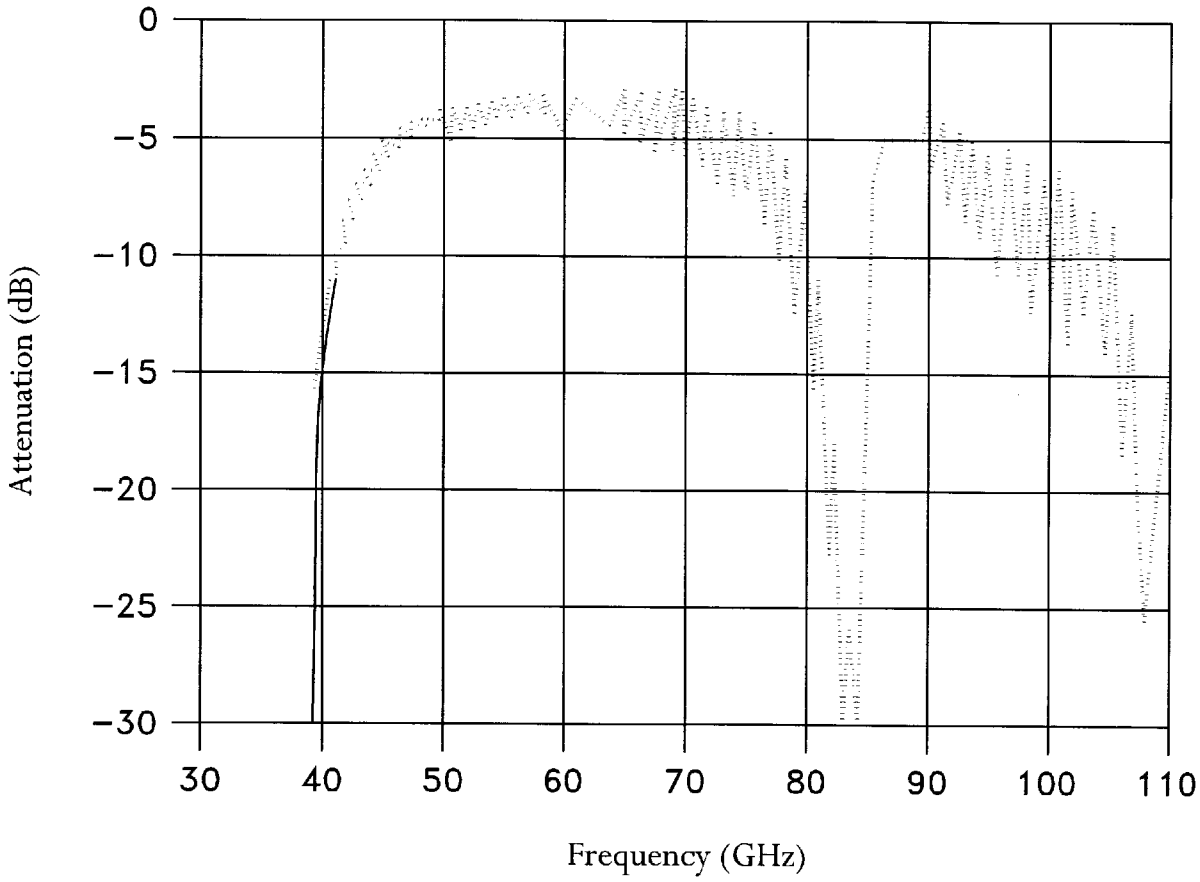
FIG. 10 (PRIOR ART)
FIG. 10 provides the attenuation versus frequency characteristics of conventional laminated waveguides using various materials.
Figure 11:
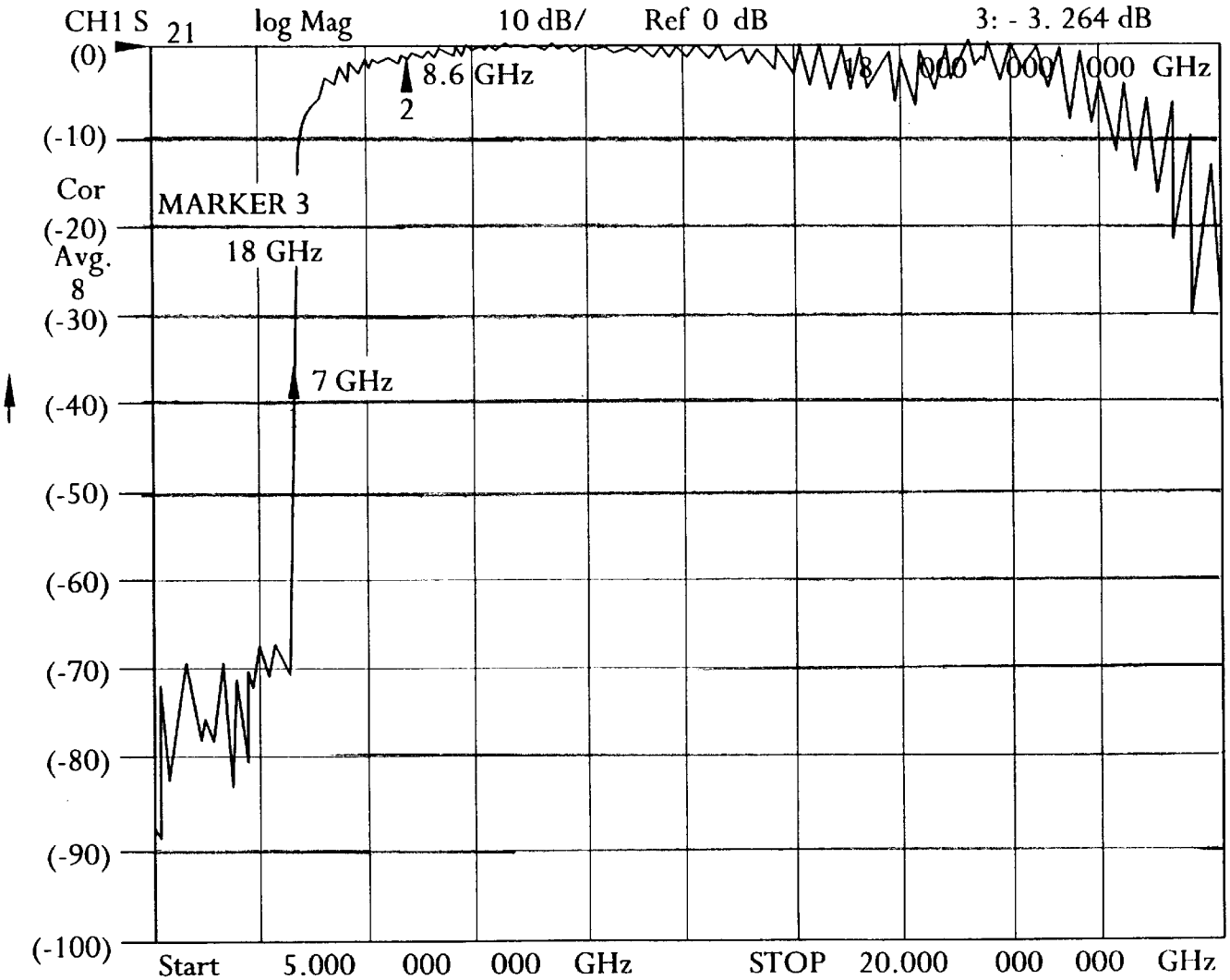
FIG. 11 provides the attentuation versus frequency characteristics of a backplane system according to the present invention.
Figure 12:
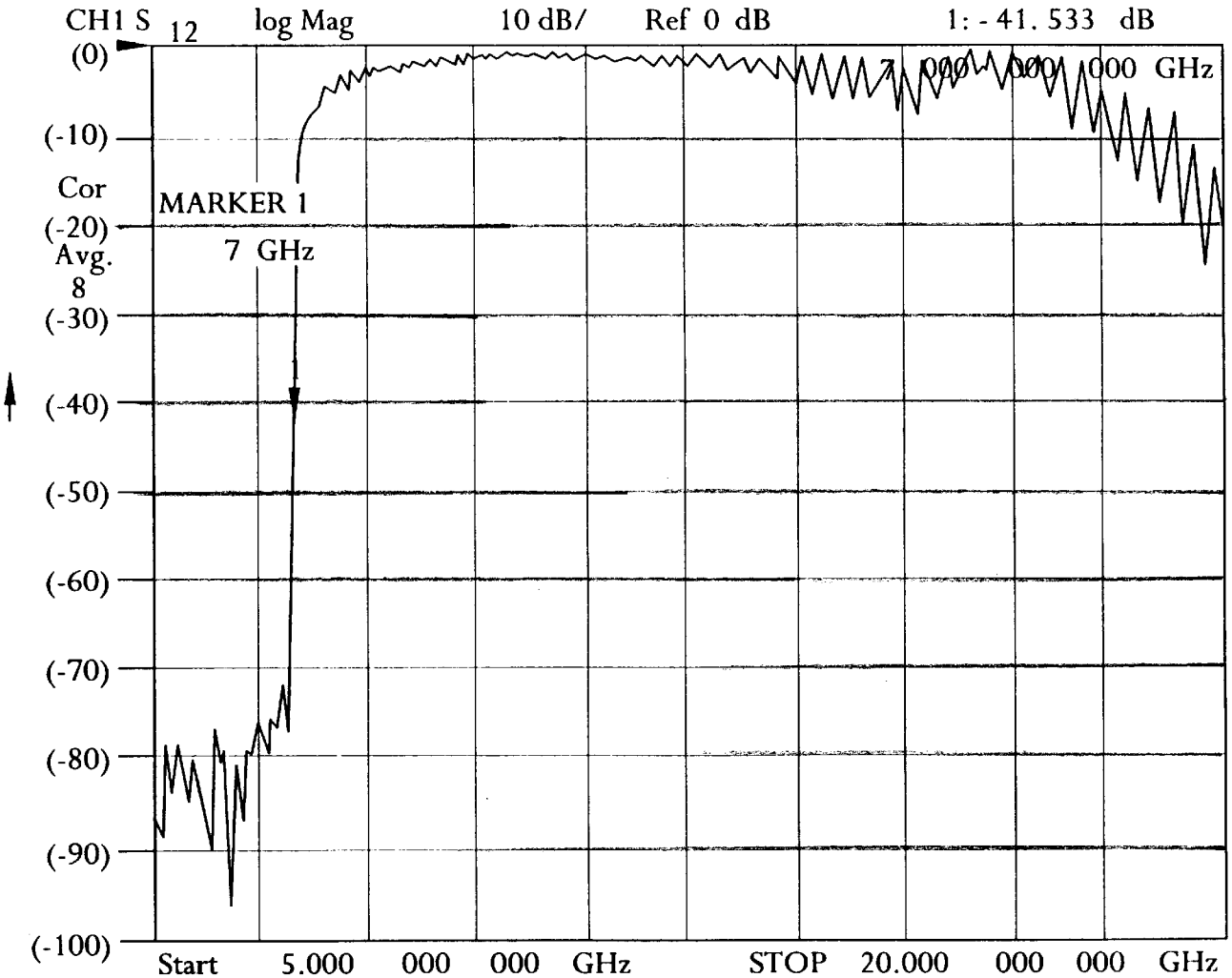
FIG. 12 provides the attenuation versus frequency characteristics of another backplane system according to the present invention.

FIGS. 10–12 also demonstrate the improvement that the present invention can have over conventional systems. FIG. 10 provides a graph of attenuation versus frequency for a typical prior art waveguide. As the frequency of the wave propagating through the waveguide increases from about 40 Ghz, the attenuation remains relatively constant at −5 dB, more or less, until the frequency reaches about 80–85 Ghz. At that point, the attenuation increases dramatically to about −30 dB. This sudden increase in attenuation occurs because, at about 80–85 Ghz, the mode of the wave changes. As frequency continues to increase beyond the 80–85 Ghz range (i.e., after the mode changes), the attenuation of the wave returns to normal. Thus, in a prior art waveguide system, a dramatic increase in attenuation of the wave can be observed at the point where the mode changes.

FIGS. 11 and 12 provide graphs of attenuation versus frequency for a typical backplane system according to the invention wherein the waveguide has a gap such as described above for preventing propagation of a lower order mode into a higher order mode. The graph of FIG. 11 represents propagation of the wave in a first direction through the waveguide. The graph of FIG. 12 represents propagation of the wave in the opposite direction through the waveguide. As shown in both FIGS. 11 and 12, the attenuation of the wave is relatively constant, at about 0 dB, in the range of frequencies from about 6 Ghz to about 20 Ghz. Thus, FIGS. 11 and 12 demonstrate that the waveguides of the present invention provide greater relative bandwidth than conventional systems.

These figures demonstrate that the waveguides of the present invention have greater relative bandwidth than conventional systems.

Although described in this section as an "air filled" waveguide, the present invention could use filler material in lieu of air. The filler material could be any suitable dielectric material.

NonRadiative Dielectric (NRD) Waveguide Backplane System

Figure 13A:
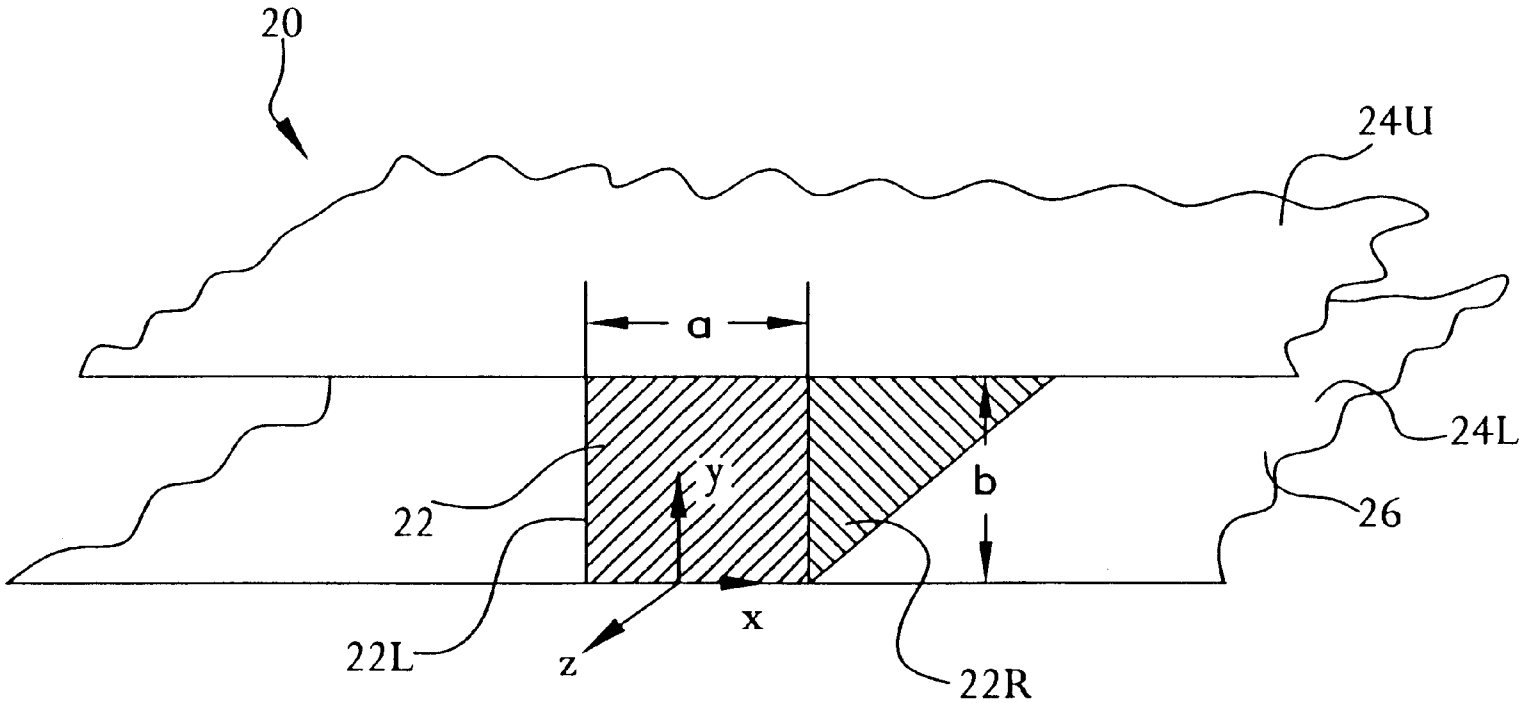
FIG. 13A depicts a non-radiative dielectric (NRD) prior art wageguide.

FIG. 13A shows a conventional TE mode NRD waveguide 20. Waveguide 20 is derived from a rectangular waveguide (such as waveguide 10 described above), partially filled with a dielectric material, with the sidewalls removed. As shown, waveguide 20 includes an upper conductive plate 24U, and a lower conductive plate 24L disposed opposite and generally parallel to upper plate 24U. Dielectric channel 22 is disposed along a waveguide axis (shown as the z-axis in FIG. 13A) between conductive plates 24U and 24L. Dielectric channel 22 has a width, a, along the x-axis and a height, b, along the y-axis, as shown. A second channel 26 is disposed along waveguide axis 30 adjacent to dielectric channel 22. U.S. Pat. No. 5,473,296, incorporated herein by reference, describes the manufacture of NRD waveguides.

Figure 13B:
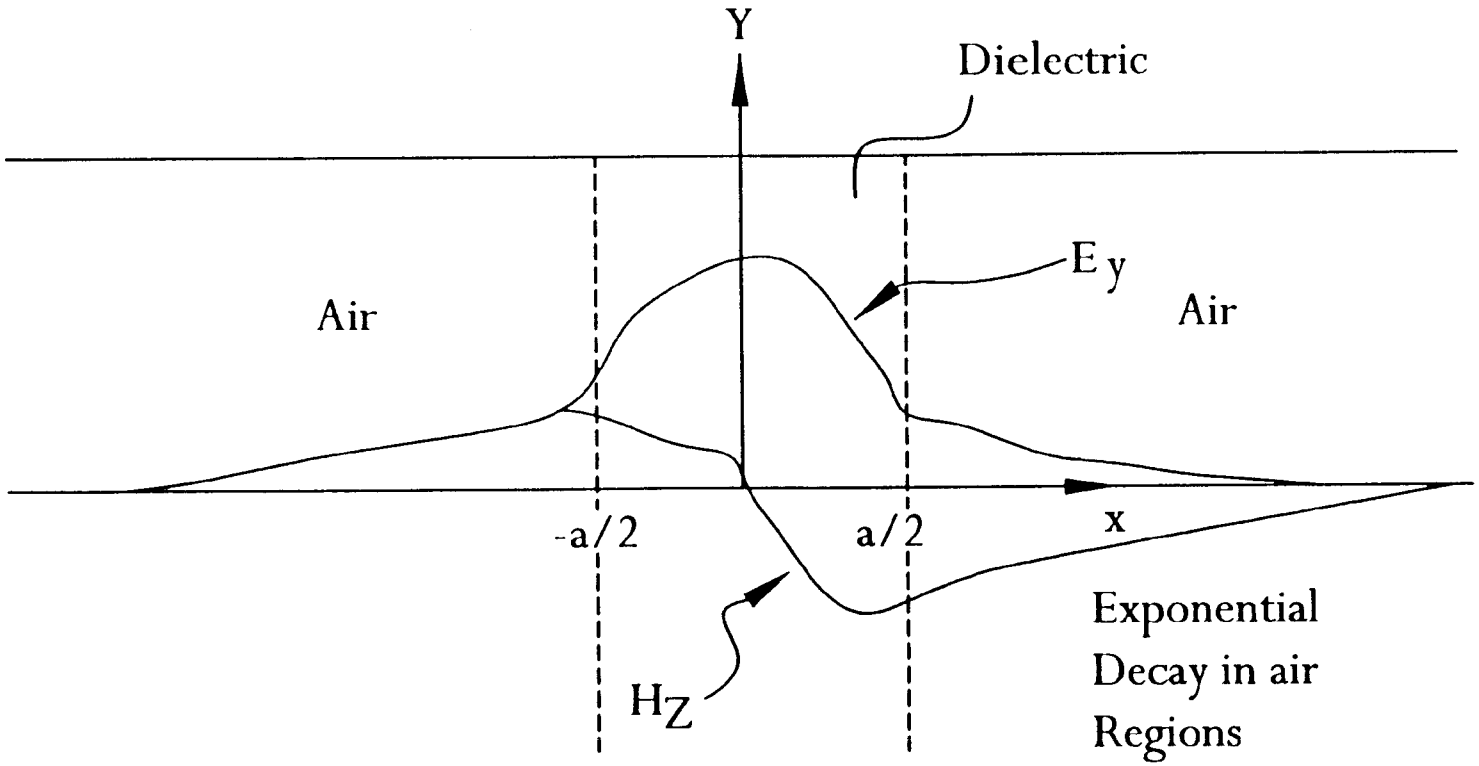
FIG. 13B shows a plot of the field patterns for the odd mode in the prior art waveguide of FIG. 13A.

Waveguide 20 can support both an even and an odd longitudinal magnetic mode (relative to the symmetry of the magnetic field in the direction of propagation). The even mode has a cutoff frequency, while the odd mode does not. The field patterns in waveguide 20 for the desired odd mode are shown in FIG. 13B. The fields in dielectric 22 (i.e., the region between—a/2 and a/2 as shown in FIG. 13B and designated "dielectric") are similar to those of the TE 1,0 mode in rectangular waveguide 10 described above, and vary as $E_y \sim \cos(kx)$ and $H_z \sim \sin(kx)$. Outside of dielectric 22, however, in the regions designated "air," the fields decay exponentially with x, i.e., $\exp(-\tau x)$, because of the reactive loading of the air spaces on the left and right faces 22L, 22R (see FIG. 13A) of dielectric 22.

Figure 14:
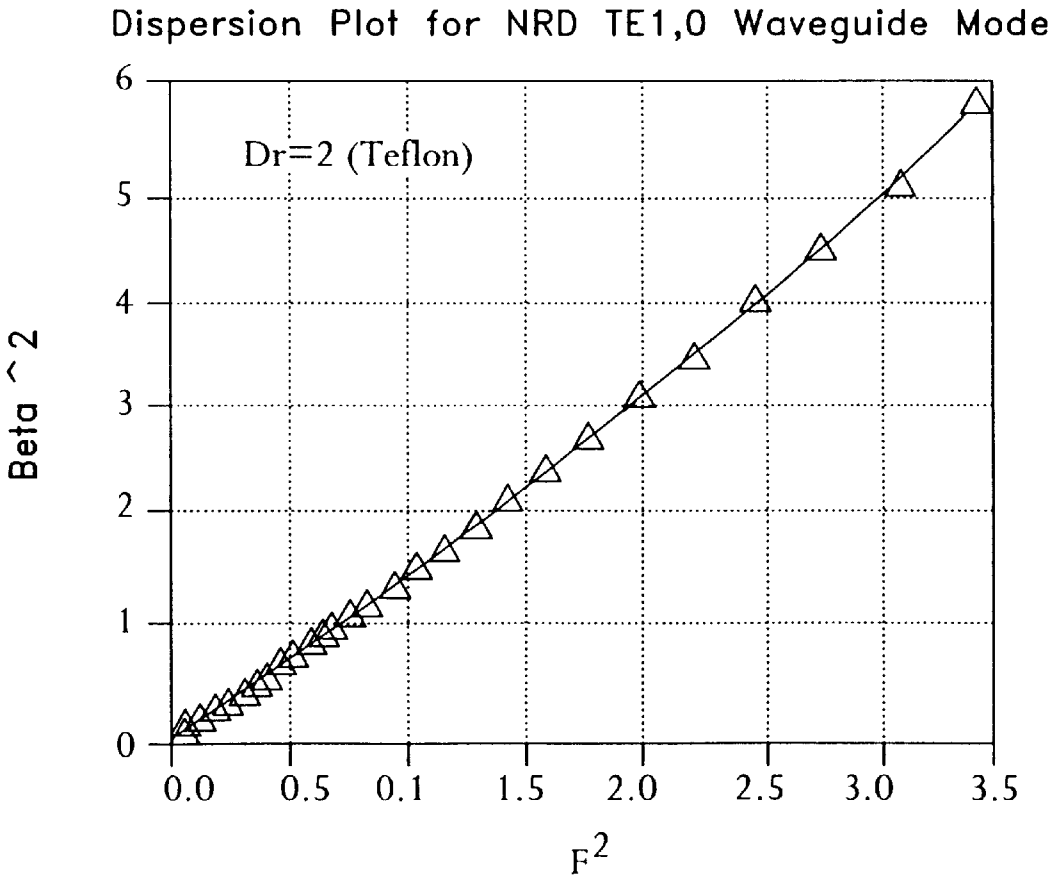
FIG. 14 shows a dispersion plot for the TE 1,0 mode in a prior art NRD waveguide.

The dispersion characteristic of this mode for a "TEFLON" guide is shown in FIG. 14, where Beta and F are the normalized propagation constant and normalized frequency, respectively. That is, $$\text{Beta}=a\beta/2 \tag{9}$$

and $$F=(a\omega/2c)(Dr-1)^{0.5}, \tag{10}$$

where c is the speed of light, and Dr is the relative dielectric constant of dielectric 22. The range of operation is for values of f between 1 and 2 where there is only moderate dispersion.

Figure 15A:
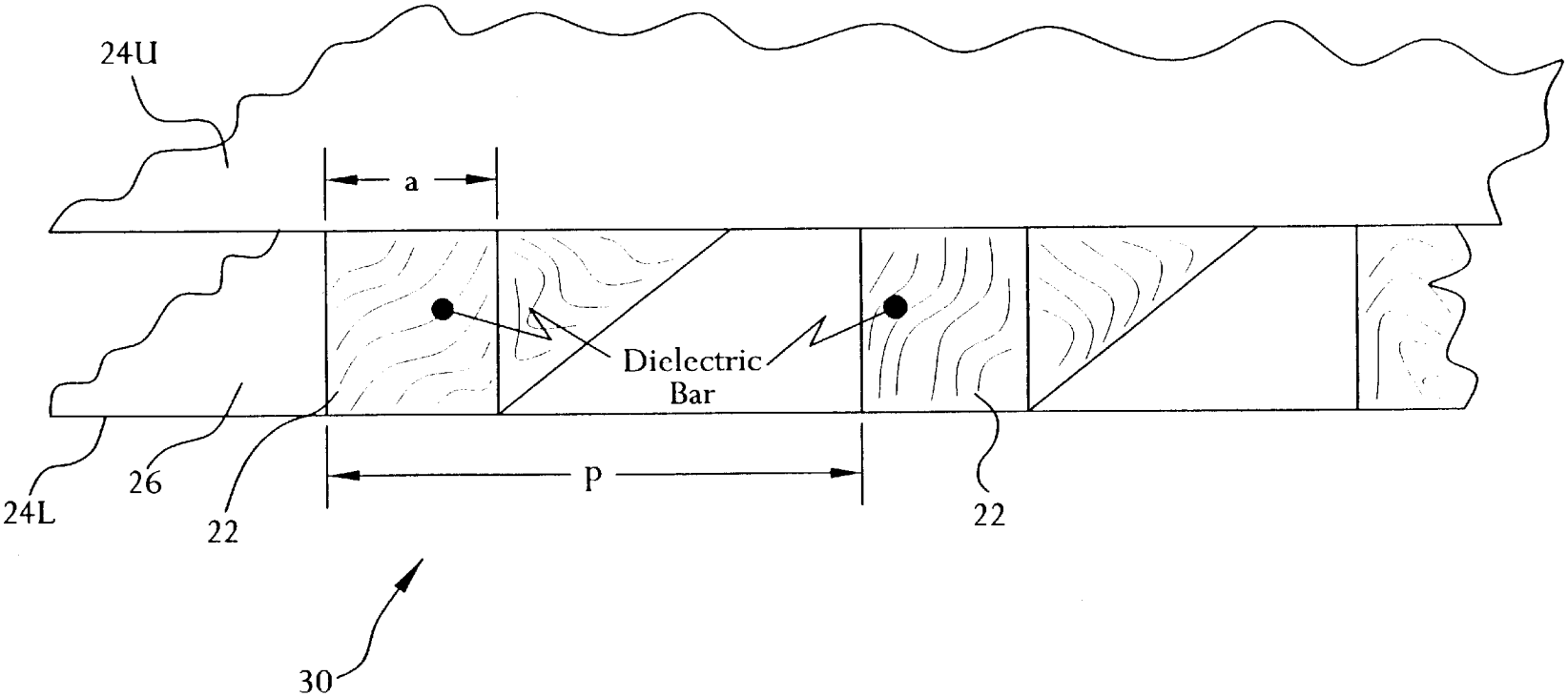
FIG. 15A depicts an NRD waveguide backplane system.
Figure 16:
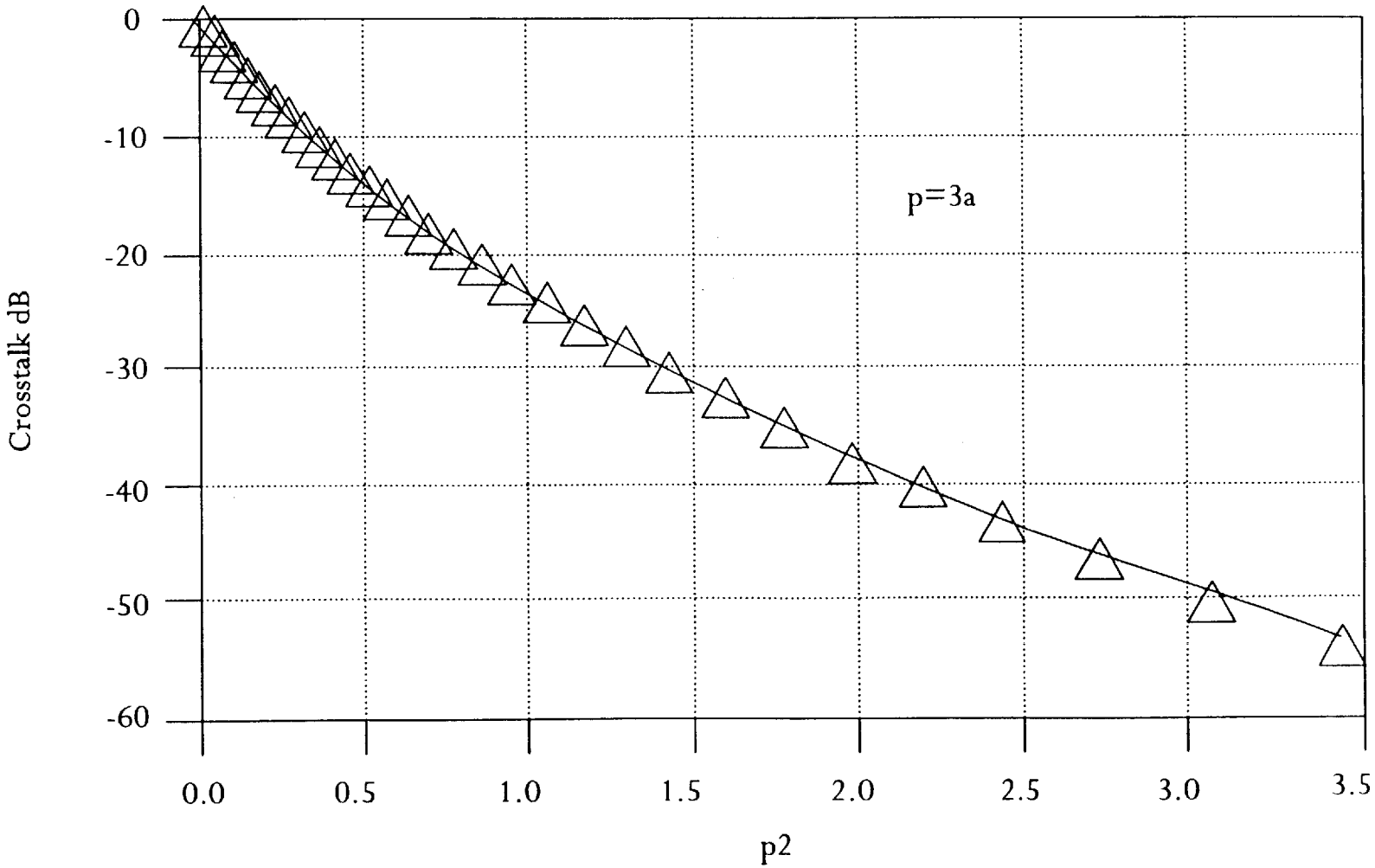
FIG. 16 shows a plot of inter-waveguide crosstalk vs. frequency for the waveguide system of FIG. 13A.

Since the fields outside the dielectric 22 decay exponentially, two or more NRD waveguides 30 can be laminated between substrates 24U, 24L, such as ground plane PCBs, to form a periodic multiple bus structure as illustrated in FIG. 15A. As shown, the bus structure can include a plurality of dielectric channels 22, each having a width, a, alternating with a plurality of air filled channels 26. The dielectric channel 22 and adjacent air-filled channel 26 have a combined width p. The first order consequence of the coupling of the fields external to dielectric 22 is some level of crosstalk between the dielectric waveguides 30. This coupling decreases with increasing pitch, p, and frequency, F, as illustrated in FIG. 16. Therefore, the acceptable crosstalk levels determine the minimum waveguide pitch $p_{min}$.

Figure 15B:
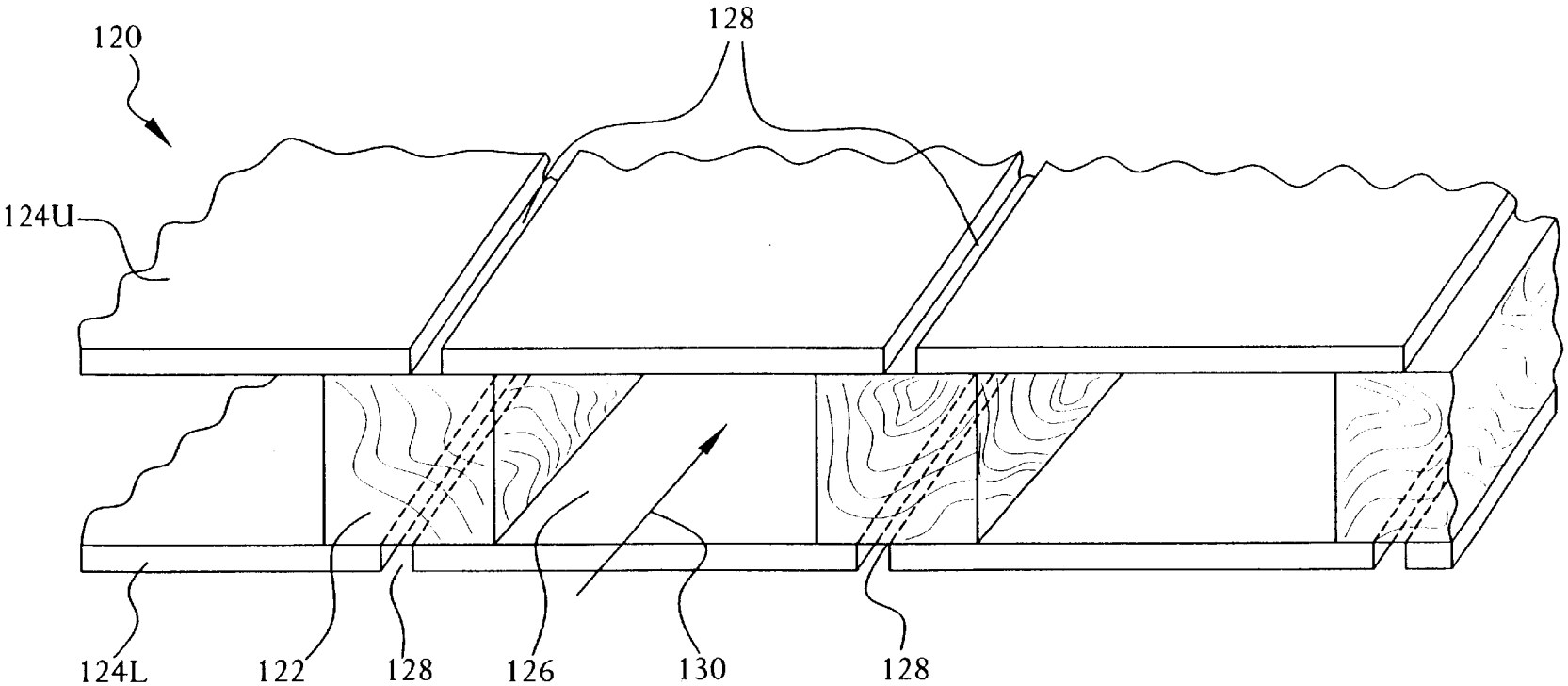
FIG. 15B depicts an NRD waveguide backplane system according to the present invention.

According to the present invention, and as shown in FIG. 15B, a longitudinal gap can be used to prevent the excitation and subsequent propagation of the higher order even mode, which has a transverse current maximum in the top and bottom ground plane structures at x=0. FIG. 15B depicts an NRD waveguide backplane system 120 of the present invention. Waveguide backplane system 120 includes an upper conductive plate 124U, and a lower conductive plate 124L disposed opposite and generally parallel to upper plate 124U. Preferably, plates 124U and 124L are made from a suitable conducting material, such as a copper alloy, and are grounded.

A dielectric channel 122 is disposed along a waveguide axis 130 between conductive plates 124U and 124L. Gaps 128 in the conductive plates are formed along waveguide axis 130. Preferably, gaps 128 are disposed near the middle of each dielectric channel 122. An air-filled channel 126 is disposed along waveguide axis 130 adjacent to dielectric channel 122. In a preferred embodiment, waveguide 120 can include a plurality of dielectric channels 122 separated by air-filled channels 126. Dielectric channels 122 could be made from any suitable material.

The bandwidth of the TE 1,0 mode NRD waveguide is dependent on the losses in dielectric and the conducting ground planes. For the case where b~a/2, and the approximation to the eigenvalue $$k\sim(\omega/c)(Dr-1)^{0.5}\sim 2/a, \tag{11}$$

holds. The attenuation has two components: a linear term in frequency proportional to the dielectric loss tangent, and a 3/2 power term in frequency due to losses in the conducting ground planes. For an attenuation of this form $$\alpha=(\alpha_1)(f)^{1.5}+(\alpha_2)f \tag{12}$$

where $\alpha_1$ and $\alpha_2$ are constants. The bandwidth-length product, BW*L, based on the upper side-band 3 dB point is $$BW*L\sim(0.345/\alpha_2)/(1/2)(\alpha_1/\alpha_2)(f_0)^{0.5}+1 \tag{13}$$

where $BW/f_0<1$, and $f_0$ is the nominal carrier frequency. Preferably, pitch p is a multiple of width a. Then, from (3), $f_0$ is proportional to 1/p. Also, bandwidth density BWD= BW/p. Plots of the bandwidth and bandwidth density characteristics for a "TEFLON" NRD waveguide, and for a Quartz NRD guide having Dr=4 and a loss tangent of 0.0001 are shown in FIG. 9. For these plots p=3a. Thus, like the characteristics of rectangular waveguide 100, NRD waveguide 120 offers increased bandwidth and, more importantly, an open ended bandwidth density characteristic relative to the parabolically closed bandwidth performance of conventional PCB backplanes.

Thus, there have been disclosed broadband microwave modem waveguide backplane systems for laminated printed circuit boards. Those skilled in the art will appreciate that numerous changes and modifications may be made to the preferred embodiments of the invention and that such changes and modifications may be made without departing from the spirit of the invention. For example, FIG. 9 also includes a reference point for a minimum performance, multi-mode fiber optic system which marks the lower boundary of fiber optic systems potential bandwidth performance. It is anticipated that the microwave modem waveguides of the present invention can provide a bridge in bandwidth performance between conventional PCB backplanes and future fiber optic backplane systems. It is therefore intended that the appended claims cover all such equivalent variations as fall within the true spirit and scope of the invention.

I claim:

1. A waveguide comprising:

a first conductive channel disposed along a waveguide axis and having a generally I-shaped cross section along the waveguide axis; and a second conductive channel disposed generally parallel to and spaced from the first channel to thereby define a gap between the first and second channels along the waveguide axis, wherein the gap has a gap width that allows propagation along the waveguide axis of electromagnetic waves in a TE n,0 mode, wherein n is an odd number, but suppresses electromagnetic waves in a TE m,0 mode, wherein m is an even number.

2. The waveguide of claim 1, wherein n is one and m is two.

3. A waveguide of claim 1 wherein each said channel has a respective upper broadwall, a respective lower broadwall opposite and generally parallel to the corresponding upper broadwall, and a respective sidewall generally perpendicular to and connected to the corresponding upper and lower broadwalls;

the upper broadwall of the first channel and the upper broadwall of the second channel are generally coplanar; and the gap is defined between the upper broadwall of the first channel and the upper broadwall of the second channel.

4. The waveguide of claim 3 wherein the lower broadwall of the first channel and the lower broadwall of the second channel are generally coplanar; and a second gap is defined between the lower broadwall of the first channel and the lower broadwall of the second channel.

5. The waveguide of claim 1, wherein the second conductive channel is generally I-shaped.

6. The waveguide of claim 1, wherein the second conductive channel is generally C-shaped.

7. The waveguide of claim 1, wherein the first channel comprises a bent sheet of electrically conductive material.

8. The waveguide of claim 1, wherein the second conductive channel comprises a bent sheet of electrically conductive material.

9. The waveguide of claim 1, further comprising:

a third conductive channel disposed generally parallel to and spaced from the first channel to thereby define a second gap between the first and third channels along the waveguide axis, wherein the second gap has a gap width that allows propagation along the waveguide axis of electromagnetic waves in a TE n,0 mode, wherein n is an odd number, but suppresses electromagnetic waves in a TE m,0 mode, wherein m is an even number.

10. The waveguide of claim 9, wherein the third conductive channel is generally C-shaped.

11. The waveguide of claim 9, wherein the third conductive channel is generally I-shaped.

12. The waveguide of claim 9, wherein the third conductive channel comprises a bent sheet of electrically conductive material.

* * * * *